US005415078A

United States Patent [19]

Beveridge

[11] Patent Number: 5,415,078

[45] Date of Patent: May 16, 1995

[54] RECIPROCATING PISTON MACHINE

[76] Inventor: John H. Beveridge, P.O. Box 202, San Clemente, Calif. 92674

[21] Appl. No.: 223,436

[22] Filed: Apr. 5, 1994

[51] Int. Cl.[6] ..... F15B 21/04

[52] U.S. Cl. ..... 92/80; 92/82; 123/73 A; 123/73 S; 417/481

[58] Field of Search ..... 123/197.4, 73 A, 73 S, 123/73 V; 417/481, 482, 483, 340; 92/82, 147, 59, 80

[56] References Cited

U.S. PATENT DOCUMENTS

| | | | |
|---|---|---|---|
| 212,944 | 3/1879 | Johnson | 417/482 |
| 1,795,551 | 3/1931 | Geisse | 123/73 A |
| 2,317,772 | 4/1943 | Huber et al. | 123/73 A |
| 2,844,131 | 7/1958 | Beveridge | 123/73 |
| 3,402,705 | 2/1967 | Stevenson | 123/119 |
| 3,621,758 | 11/1971 | Beveridge | 123/73 A |

FOREIGN PATENT DOCUMENTS

| | | | |
|---|---|---|---|
| 40066 | 7/1957 | Poland | 123/73 A |
| 2834 | 2/1915 | United Kingdom | 123/73 S |

*Primary Examiner*—Thomas E. Denion

[57] ABSTRACT

This invention relates to reciprocating piston machines which use the crankcase for pumping air or charge. The connecting rod with extension partitions the interior of the crankcase including the lower cylinder into two varying volumes during a portion of each revolution of the crankshaft. A unique feature is that the designer can choose the capacity of the crankcase pump independent of other significant design parameters such as the ratio length of connecting rod/stroke and the ratio stroke/-bore.

6 Claims, 3 Drawing Sheets

RECIPROCATING PISTON MACHINE

FIELD OF THE INVENTION

My invention relates to reciprocating piston machines in which the piston, the cylinder, the connecting rod with extension, the crankshaft and crankcase form the elements of an oscillating vane machine.

DESCRIPTION OF RELATED ART

In substantially all of the present day reciprocating piston machines a crankshaft and a connecting rod are used to transmit power to or away from the piston. Since a crankshaft, a connecting rod, a piston, and the structure surrounding these components are already present is desirable objective to have these components function in a manner so that they provide the air induction capacity desired by the designer. This invention accomplishes this objective in a simple, unique way. In my earlier U.S. Pat. No. 2,844,131, Jul. 22, 1958, I disclosed a similar reciprocating piston machine in which the piston, the cylinder, the crankshaft, the crankcase and the connecting rod formed the elements of an oscillating vane pump. The invention did not provide the designer with a choice of the magnitude of the volume of air pumped by the crankcase compared to the piston volumetric displacement. As a result there was a limited range of flexibility in design. The invention disclosed herein overcomes the inherent design limitation of the previous invention without increasing the number of moving parts or significantly increasing the weight, overall physical size or cost of the machine. As a result the utilization of the present invention is expected to be much greater than was the case of my previous invention, U.S. Pat. No. 2,844,13 1. Other related prior art includes U.S. Pat. No. 3,402,705, J. D. Stevenson, Sep. 24, 1968. In his invention several additional components are included in the crankcase to form a oscillating vane pump. These additional components cause added complexity, friction, wear, cost and weight not present in the current invention.

My invention overcomes the above discussed difficulties inherent in presently known crankcase compressor reciprocating piston machines. For similar reciprocating piston machines (engines) the power output potential is proportional to the maximum air induction capacity per cycle. Thus an increase in air induction capacity without materially increasing the physical size, weight or cost of the machine is expected to provide increased power.

An object of my invention is the design, construction and arrangement of components to increase the aspirating or air induction capacity per cycle to an amount substantially in excess of the volumetric displacement of the piston. Another object of my invention is to achieve the above mentioned increase in aspirating or breathing capacity without the use of auxiliary machinery, without increasing the number of moving parts and without materially increasing the size, weight, or cost of the machine. Another object of my invention is to provide a basic configuration in which the designer can choose or adjust the volume of air induced relative to the volumetric displacement of the piston. Thus the designer may choose increased pumping capacity to supercharge the cylinder. Another object of this invention is to make a crankcase scavenge pump with a pumping characteristic which corresponds to the cylinder inlet transfer port open area, i.e., substantial pumping occurs while the cylinder inlet transfer ports are open. Another object of this invention is to make a two-cycle engine whose power and operating characteristics are relatively insensitive to back pressure of the exhaust system thereby allowing an effective muffler system. Another object of my invention is to make a reciprocating piston machine having a large breathing capacity and having small vibration forces, i.e., the design is compatible with my co-pending patent application having Ser. No. 08/144,675. Another object of my invention is to provide a bypass control system for the reciprocating piston machine that minimizes the partial load pumping power required.

BRIEF DESCRIPTION OF THE DRAWINGS

In accomplishing these and other objects, I have provided improved details of structure, exemplary forms of which are illustrated in the accompanying drawings, wherein.

DESCRIPTION OF PREFERRED EMBODIMENT

Figure 1:
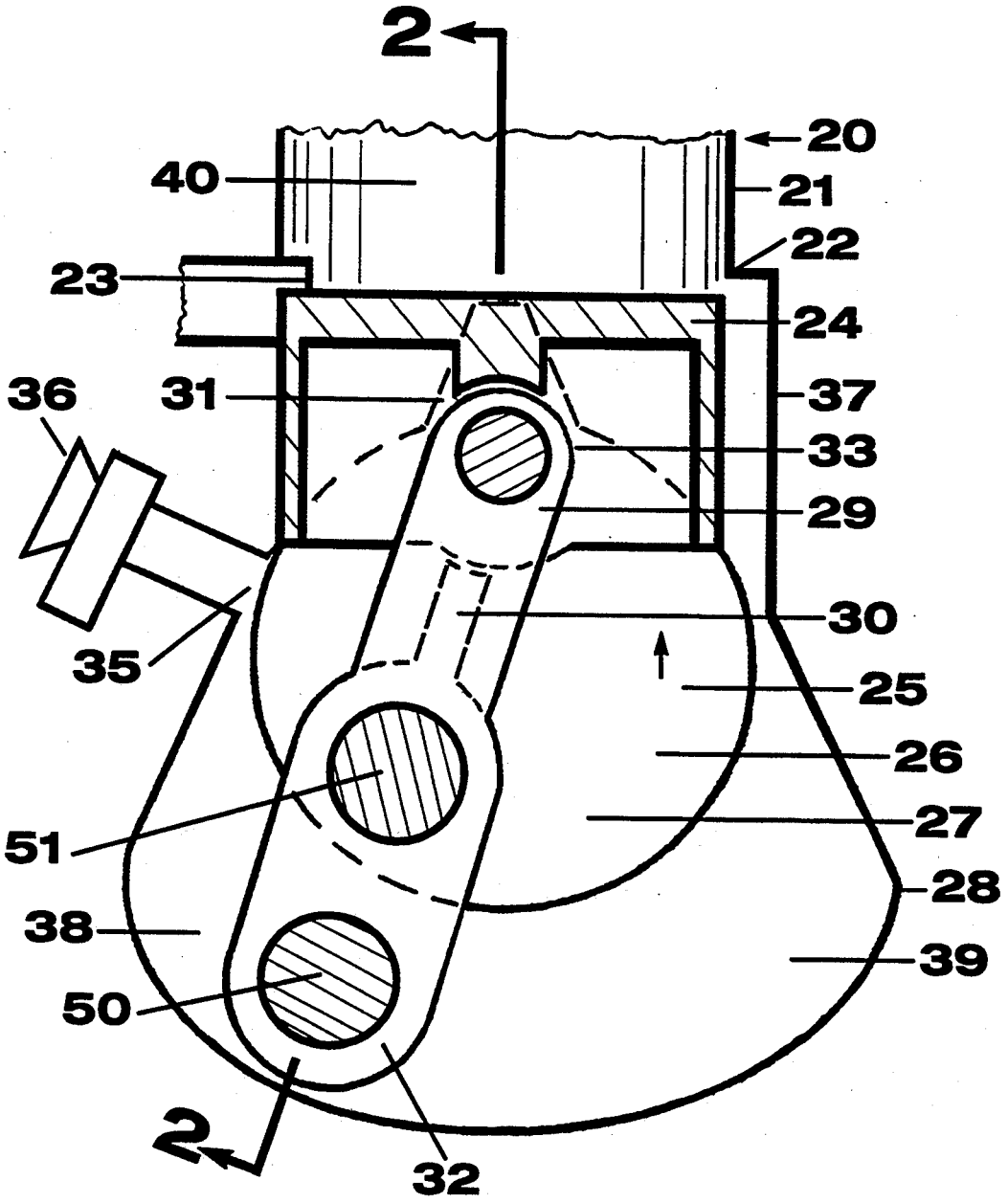
FIG. 1 is a longitudinal section, of a single cylinder, two-cycle internal combustion engine in a plane perpendicular to the axis of the crankshaft and through the axis of the cylinder.
Figure 2:
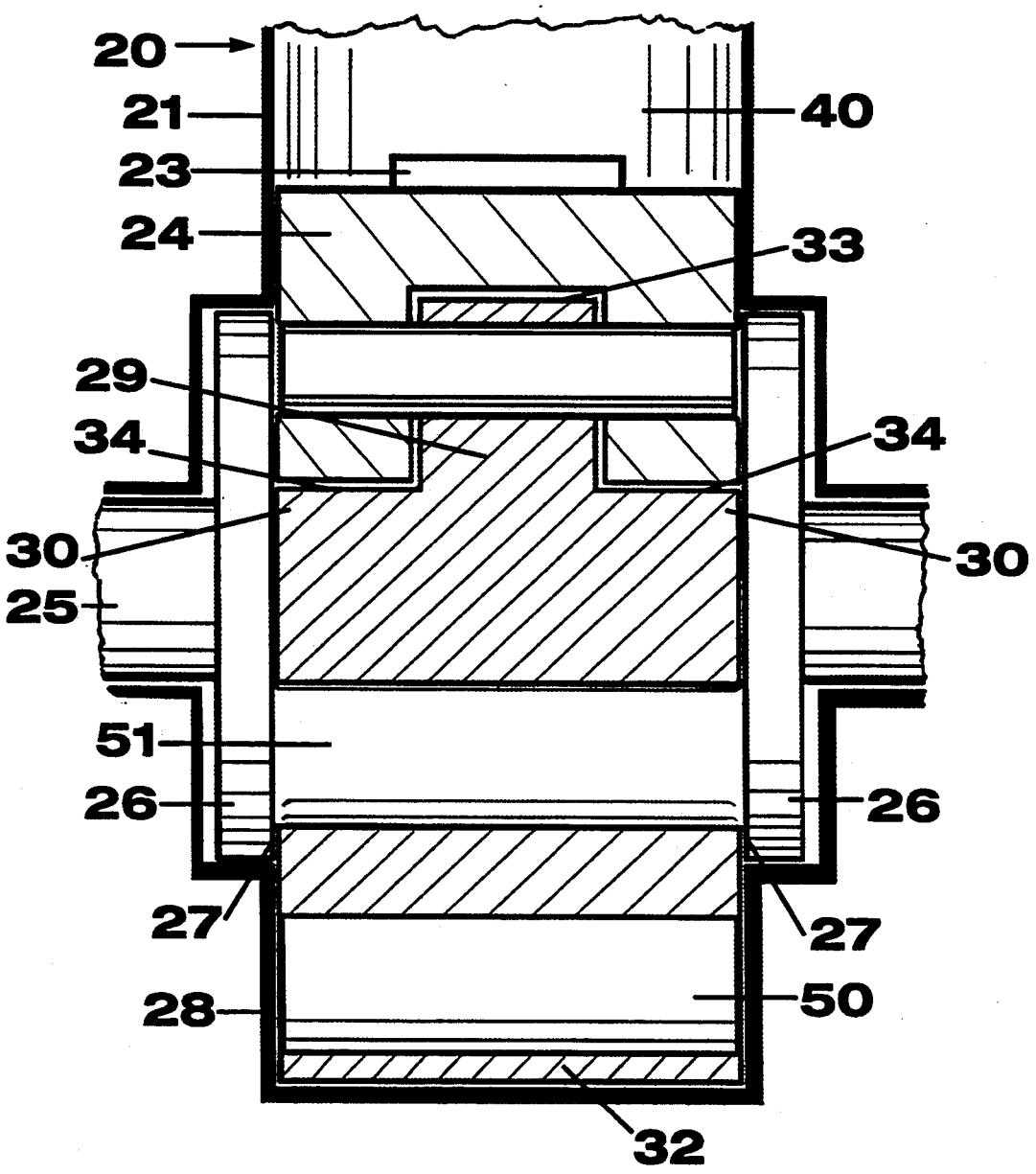
FIG. 2 is a section on line 2—2 of FIG. 1.

In FIGS. 1 and 2, I have shown an embodiment of a two-cycle internal combustion engine designated generally as 20. The engine 20 comprises a cylinder 21 having inlet port or transfer port 22 and exhaust port 23 which are periodically opened and closed by the reciprocating motion of the piston 24. The crankshaft 25, rotatably mounted within the crankcase 28, has full circular webs or discs 26 which have their inner faces or surfaces 27 machined so they are flush or aligned with the bore of the cylinder at its maximum dimensions in the planes perpendicular to the axis of the crankshaft. The peripheries of the webs are machined to allow no more than a close clearance in the crankcase 28. The crankshaft turns in a counterclockwise direction, FIG. 1.

The connecting rod 29 is pivotally connected at the upper end to the piston 24 and rotatably connected to the crankshaft 25 at the central section. The connecting rod 29 is substantially as wide as the bore of the cylinder or the distance between the inner faces of the crankshaft webs 27 and the inner surface of the wall of the cylinder. The cylinder wall has diametric reliefs 31 machined in it to prevent interference with the side edges of the connecting rod 30. The diametric cylinder reliefs 31, hereinafter referred to as flats, are flush with the inner faces of the crankshaft webs 27.

The connecting rod 29 has an extension 32 opposite the piston pin end of the connecting rod 33. The extension 32 is as wide as the bore and has no more than a close clearance with respect to the inner surfaces of the crankcase 28 during a portion of each revolution of the crankshaft 25. In addition., the piston pin end of the connecting rod 33 is circular and forms a close clearance with respect to the inside or underside of the piston 24. Furthermore, the upper ends of the connecting rod side webs 34 form a close clearance with respect to the piston 24.

Thus, there is formed partition means including the connecting rod 29 with extension 32, said partition means divides the crankchamber or the interior of the crankcase and the interior of the cylinder below the piston into two mutually isolated compartments or chambers during a portion of each revolution of the crankshaft. One chamber 38, is on the left hand side of the connecting rod 29 and one chamber 39, is on the right hand side of the connecting rod 29 with extension 32.

The crankcase 28 is provided with a charge suction port or crankcase port 35. In communication with the crankcase port 35 is carburetor 36. A transfer passage 37 extends between the interior of the crankcase or crankchamber and the cylinder inlet port 22. The cylinder 21 may be fitted with a spark plug for ignition of the charge (not shown). The extension 32 may be provided with a balance weight 50 per my co-pending U.S. patent application Ser. No. 08/144,675. The balance weight is sized to cause the center of gravity of the piston-connecting rod assembly to be substantially on the axis of rotation of the crankpin 51. Thus counterweights (not shown) on the crankshaft 25 can balance the vertical and horizontal inertial forces of the reciprocating piston machine 20.

OPERATION

In operation when the piston 24 is at the top of its stroke, the entire crankchamber, or interior of the crankcase, is in communication with the interior of the cylinder below the piston and the crankcase port 35. This condition exists during the down stroke of the piston until the extension of the connecting rod 32 passes the crankcase port 35. At this point the connecting rod 29 with extension 32 and piston 24 divide the interior of the crankcase and the interior of the cylinder below the piston into two chambers or two compartments. One chamber, designated 38, is associated with the crankcase port 35 and the other chamber, designated 39, is associated with the transfer passage 37. This condition is maintained until the crankshaft 25, connecting rod 29 with extension 32 and piston 24 reach a predetermined position, which is usually after the scavenging process is over.

It is apparent that during the down stroke of the piston, after the extension of the connecting rod 32 has passed the crankcase port 35, the chamber 38 associated with the crankcase port 35 is increases in volume and the chamber 39 associated with, or in communication with, transfer passage 37 is decreases in volume. The continuously changing volumes of the two chambers 38 and 39 produce the pumping or compressing action of the crankcase compressor.

The cylinder scavenging process commences during the down stroke of the piston when the piston 24 uncovers the cylinder inlet port 22. Charge compressed in the chamber 39 flows through the transfer passage 37 and the cylinder inlet port 22 thereby scavenging the interior of the cylinder above the piston 40. The scavenging process continues until the piston 24 covers the cylinder inlet port 22 on the up stroke of the piston 24.

The chamber 39 associated with or in communication with the transfer passage 37, i.e., the crankcase compressor clearance volume, continues to decrease in volume for an interval after the bottom-dead-center position of the piston even though the piston 24 has commenced its up stroke due to the motion of the connecting rod 29 with extension 32 compared to the motion of the piston 24. This occurs because the extension 32 is moving rapidly to the right causing the crankcase compressor clearance volume 39 to decrease while the piston 24 is slowly rising in the cylinder 21 tending to cause the clearance volume 39 to increase.

At some position, usually after the scavenging process is over, the chamber 39 associated with the transfer passage 37 begins to increase in volume because of the relative motions or displacements of the connecting rod 29 with extension 32 and the piston 24 during the latter portion of the up stroke of the piston 24. When this condition is reached, or shortly thereafter, the close clearance between the extension 32 and the inner surface of the crankcase 28 is terminated and the cycle is concluded when the piston reaches top-dead-center position. Thus, the piston and the connecting rod with extension function as a unit within the cylinder and crankcase to divide the interior of the cylinder below the piston and the interior of the crankcase into two mutually isolated chambers during a portion of each revolution of the crankshaft.

The pumping capacity of the crankcase pump compared with the piston displacement per my original invention, U.S. Pat. No. 2,844,131, is approximately proportional to the ratio stroke/bore. Thus an engine designed with a ratio stroke/bore equal to 0.7 has only 70 percent of the crankcase pumping capacity of an engine designed with a ratio stroke/bore of 1.0. Since engines with a lower ratio stroke/bore (approximately 0.70) are relatively more compact, have lower weight and can run at higher speed for increased power the inherent reduced pumping capacity is a shortcoming. In the present invention, the designer can choose the crankcase pumping capacity per unit piston displacement independent of the choice of the parameter stroke/bore. Increased pumping capacity is obtained by increasing the length of the extension on the connecting rod and the surrounding structure.

In recent years there has been a trend to design two-cycle engines using a short connecting rod compared to the stroke of the engine, i.e., the ratio of length of the connecting rod (from the axis of the crankpin to the piston pin) to the stroke of the piston is in the range 1.6–1.5, down from 2.0–1.8. A short connecting rod results in a much more compact engine having relatively lower weight. Since the pumping capacity of a connecting rod per my original U.S. Pat. No. 2,844,131, is approximately proportional to the length of the connecting rod, a reduced length connecting rod is accompanied by a reduced pumping capacity.

The invention disclosed herein provides a means for the designer to increase the pumping capacity of the crankcase pump independently of the selection of the major engine design parameter, ratio length of connecting rod/stroke. Increased length of the extension provides increased pumping capacity without affecting the choice of stroke/bore or length of connecting rod/stroke.

Another significant feature of the extension of the connecting rod opposite the piston per this invention is that the extension for pumping is compatible with the moment arm for the balance weight means described in my co-pending patent application Ser. No. 08/144,675. Thus the extension on the connecting rod per this invention and the balance weight per my co-pending invention can provide a single cylinder piston machine with large breathing capacity (designer's choice) and near zero vertical and horizontal vibration forces.

Another facet of this invention is that the positive displacement pumping occurs primarily during the portion of the cycle when the transfer ports are open. Conventional crankcase pumps have precompression and essentially no pumping capacity during the portion of the cycle when the transfer ports are open. Thus the scavenge flow process is essentially a blowdown flow process which is relatively independent of speed. This results in an excessive mixing loss at low speed causing poor scavenge efficiency and hard starting. Also, the large clearance volume without positive displacement pumping makes the engine power very sensitive to back pressure, i.e., more back pressure less through flow and less power output. As a result, most two-cycle engines are fitted with ineffective mufflers causing noisy operation. The current invention provides a majority of the scavenge flow at/near bottom dead center when the transfer ports are at/near maximum opening. As a result, the scavenge flow process is more nearly at constant pressure (as a function of crank angle) which means that scavenge efficiency is greatly improved at all speeds and the engine can tolerate a higher back pressure without loss of through flow and a corresponding loss of power output, i.e., the exhaust flow can be effectively muffled making a powerful and quiet engine.

Figure 3:
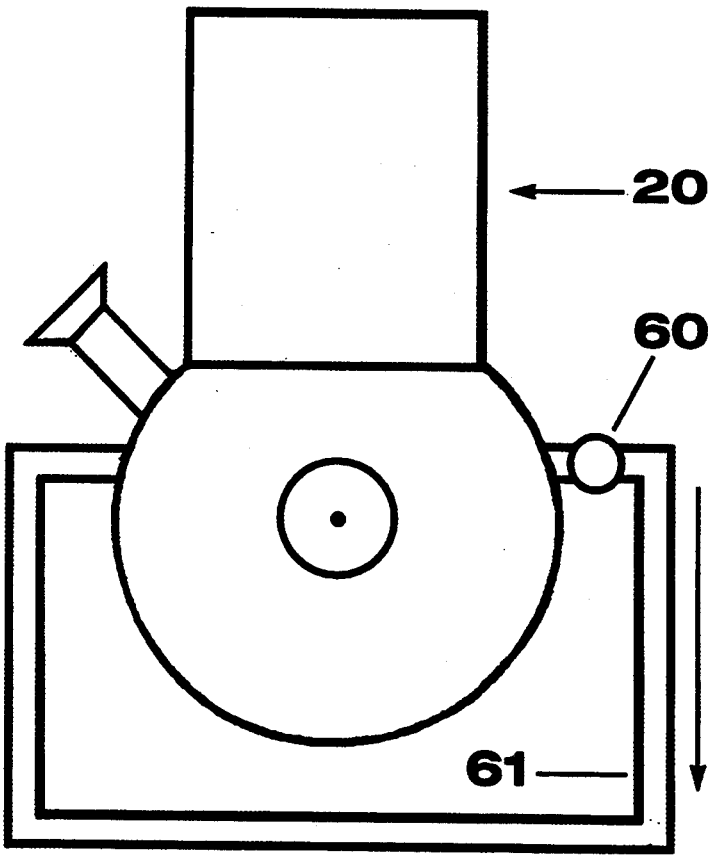
FIG. 3 is a flow schematic of a bypass control system.

In FIG. 3 there is shown a bypass flow control system which reduces pumping power at partial load as compared with a throttle type system. The bypass valve 60 and return to suction duct 61 provide an alternative flow path for the air/charge pumped by the crankcase compressor per this invention. The alternative flow path (versus the transfer passage) minimizes the pressure rise across the connecting rod with extension thereby reducing the power input to the positive displacement crankcase pump.

Although the invention is described with respect to a preferred embodiment, modifications thereto will be apparent to those skilled in the art. Therefore, the scope of the invention is to be determined by reference to the claims which follow.

I claim:

1. A reciprocating piston machine comprising:

a cylinder having a bore associated therewith, a crankcase in communication with said cylinder, a piston reciprocal in said cylinder, a crankshaft rotatably mounted within said crankcase, partition means dividing an interior of the crankcase and an interior of the cylinder below the piston into two mutually isolated chambers during a portion of each revolution of said crankshaft, said partition means including a connecting rod rotatably connected to said crankshaft, said connecting rod pivotally connected at one end to said piston, said connecting rod having an extension at an opposite end effecting said partition means.

2. The machine of claim 1 wherein said connecting rod is as wide as the bore of said cylinder.

3. The machine of claim 1 wherein said crankcase has a suction port, and transfer passage means in communication with said crankcase and said cylinder.

4. The machine of claim 1 wherein said extension end of said connecting rod includes a balance weight.

5. The machine of claim 1 wherein said cylinder has flats.

6. The machine of claim 1 wherein said crankcase has a bypass duct extending from a chamber associated with a transfer passage to a chamber associated with a crankcase suction port, said bypass duct having a control valve.

* * * * *